US005112720A

United States Patent [19]

Karino

[11] Patent Number: 5,112,720

[45] Date of Patent: May 12, 1992

[54] COLOR DIFFUSION TRANSFER PHOTOGRAPHIC FILM UNIT WITH DYE TRAPPING LAYER

[75] Inventor: Yukio Karino, Kanagawa, Japan

[73] Assignee: Fuji Photo Film Co., Ltd., Kanagawa, Japan

[21] Appl. No.: 495,968

[22] Filed: Mar. 20, 1990

[30] Foreign Application Priority Data

Mar. 20, 1989 [JP] Japan ..... 1-68749

[51] Int. Cl.[5] ..... G03G 5/54

[52] U.S. Cl. ..... 430/213; 430/212; 430/214; 430/215; 430/220; 430/216

[58] Field of Search ..... 430/212, 213, 214, 215, 430/220, 216

[56] References Cited

U.S. PATENT DOCUMENTS

| | | | |
|---|---|---|---|
| 3,620,731 | 11/1971 | Peisach | 430/212 |
| 3,836,365 | 9/1974 | Reid | 430/212 |
| 3,930,864 | 1/1976 | Abel et al. | 430/212 |
| 4,459,346 | 7/1984 | Bishop et al. | 430/215 |
| 4,499,174 | 2/1985 | Bishop et al. | 430/220 |

*Primary Examiner*—Richard L. Schilling
*Attorney, Agent, or Firm*—Sughrue, Mion, Zinn, Macpeak & Seas

[57] ABSTRACT

A color diffusion transfer photographic film unit is disclosed, which comprises:

(1) a support having a light-shielding function in itself and/or having thereon a layer having a light-shielding function;

(2) a light-sensitive element on the support, the element comprising in order from the support at least;

(a) a color image-receiving layer comprising a mordant agent in a binder, (b) a peeling layer, and (c) at least one silver halide emulsion layer associated with a color image-forming substance;

(3) a light-shielding agent-containing alkali processing composition; and (4) a cover sheet comprising at least a layer having a neutralizing function on a transparent support;

wherein the cover sheet is characterized by having a dye-trapping layer comprising a mordant agent in a binder adjacent the alkali processing composition.

13 Claims, No Drawings

COLOR DIFFUSION TRANSFER PHOTOGRAPHIC FILM UNIT WITH DYE TRAPPING LAYER

FIELD OF THE INVENTION

The present invention relates to a color diffusion transfer photographic film unit and, more precisely, to a peeling-type daylight-processable color diffusion transfer photographic film unit wherein the image-receiving element is peeled, after being exposed and processed, and the color image formed is observed directly, not through the support.

BACKGROUND OF THE INVENTION

Conventional color diffusion transfer photographic film units can be classified into two groups, peeling units type and non-peeling units type. In the former group of peeling units type, the light-sensitive layer and the color image-receiving layer are separately coated on different supports. After being imagewise exposed, the light-sensitive element and the color image-receiving element are superposed together and a processing composition is spread therebetween. After being processed, the color image-receiving element is peeled away from the light-sensitive element to obtain the color image transferred to the color image-receiving layer.

The peeling unit type is characterized in that the color image as formed on the image-receiving layer coated on the support may directly be observed and therefore the color reproducibility is extremely excellent. Accordingly, the peeling unit type does not lower the image quality which is different from the non-peeling unit type. On the other hand, however, the peeling unit type has some disadvantages in that the light-sensitive element and the image-receiving element are superposed together in the body of the camera and such a procedure is often inconvenient. Additionally, the peeled image-carrying element is often sticky with the alkaline processing solution used. Such sticky alkaline processing solution often adheres to the surroundings and stains them and handling of the processed film is therefore inconvenient.

As opposed to this case, the non-peeling unit type has a color image-receiving layer and a silver halide emulsion layer provided between a transparent support and another support. This includes two forms. One has both the image-receiving layer and the silver halide emulsion layer coated on the same transparent support and the other has the two layers separately coated on different supports.

In the former case, a white reflecting layer is provided between the image-receiving layer and the silver halide emulsion layer. In the latter case, a white pigment is incorporated into the processing composition to be spread between the image-receiving layer and the silver halide emulsion layer. Accordingly, in both cases, the color image transferred to the image-receiving layer can be observed with the reflecting light.

As the characteristic feature of the non-peeling unit type, the unit can be handled with extreme ease and is free from the inconveniences of the above-mentioned peeling unit type. Precisely, the processed film is free from the stickiness of the processing solution used and the inconvenient superposing of the film sheets is unnecessary. On the other hand, however, the lowering of the image quality is inevitable in the case of the non-peeling unit, since it is different from the above-mentioned peeling unit. This is because the color image formed is to be observed through the transparent support and therefore the color saturation degree is lowered because of the surface reflection and additionally the whiteness degree in the white portion is insufficient because of the insufficiency of the reflectivity of the white reflecting layer.

In addition, there is another inconvenience in that the thickness of the finally obtained print is large since the print still has the processed emulsion layer, pod and cover sheet.

In order to overcome these problems, JP-A-63-226649 corresponding to U.S. Pat. No. 4,839,257 (the term "JP-A" as used herein means an "unexamined published Japanese patent application") has proposed a color diffusion transfer photographic film unit, which comprises a light-sensitive element having at least (a) a layer having a neutralizing function, (b) a color image-receiving layer, (c) a peeling layer and (d) at least one silver halide emulsion layer associated with a color image-forming substance provided in order on a white support, a light-shielding agent-containing alkali processing composition and a transparent cover sheet.

One preferred embodiment of the proposed film unit is composed of a light-sensitive element having at least (a) a layer having a neutralizing function, (b) a color image-receiving layer, (c) a peeling layer and (d) at least one silver halide emulsion layer associated with a color image-forming substance provided in order on a support, a light-shielding agent-containing alkali processing composition and a transparent cover sheet, where the emulsion layer has a light-shielding function or the side opposite to the side on which the processing composition is to be spread. The support is a white support and the silver halide emulsion layer in the light-sensitive element is composed of plural layers. In the case of the preferred embodiment, the distance (D) between the dye formed from the color image-forming substance associated with the silver halide emulsion layer that is nearest to the color image-receiving layer and the position of the color image-receiving layer to which the thus formed dye is to be directly diffused is extremely short while the distance (D') between the dye formed from the color image-forming substance associated with the silver emulsion layer that is most remote from the color image-receiving layer and the position of the color image-receiving layer to which the thus formed dye is to be directly diffused is relatively long, and therefore, the ratio of D'/D is large.

Accordingly, the produced in the position nearest to the color image-receiving layer may give a transferred color image in a short period of time while the dye produced in the position remote from the color image-receiving layer would require a long period of time before it gives a transferred color image in the color image-receiving layer. As a result, the image-completing time is prolonged as a whole and additionally the variation of the color balance during the course before completion of the final image is increased. The prolongation of the image-completing time and the variation of the color balance of the final image before and after completion of the final image would a fatal defect in the case of the above-mentioned photographic film unit where observation of the final image to be obtained could be effected only after the image-having film is peeled from the film unit. Accordingly, elimination of the problems is strongly desired in this technical field.

In addition, the photographic element of the kind where both the layer having a neutralizing and the color image-receiving layer are provided on the same support and the position of the two layers is still maintained after formation of the intended image in the image-receiving layer has some other problems with respect to the quality of the film properties.

For instance, the adhesion of the color image-receiving layer is poor and therefore it is separated from the lower layer on peeling; the surface of the image-having film is easily scratched immediately after peeling; the adhesion of the color image-receiving layer is poor and therefore it is easily separated from the lower layer when the film is wetted with water after image formation; and the film is easily broken or cracked when it is bent under a low-humidity atmosphere after image formation.

SUMMARY OF THE INVENTION

One object of the present invention is to provide a novel daylight-processable film unit, which has both the excellent characteristic of a peeling type color diffusion transfer unit by giving an image of high image quality and the excellent characteristic of a non-peeling type color diffusion transfer unit by being easy to handle.

Another object of the present invention is to provide a color diffusion transfer photograph of high image quality which is not sticky after being peeled from the film unit.

Still another object of the present invention is to provide a method for forming a diffusion transfer image where a color image of high image quality is formed on a non-sticky film by daylight processing.

Still another object of the present invention is to provide a novel daylight-processable film unit which may be processed in a short image-forming period of time.

Still another object of the present invention is to provide a color diffusion transfer film unit having an excellent film quality.

Other objects and effects of the present invention will be apparent from the following description.

The above-mentioned objects of the present invention have been attained by a color diffusion transfer photographic film unit, comprising:

(1) a support having a light-shielding function in itself and/or having thereon a layer having a light-shielding function;

(2) a light-sensitive element on the support, the element comprising in order from the support at least:

(a) a color image-receiving layer comprising a mordant agent in a binder, (b) a peeling layer, and (c) at least one silver halide emulsion layer associated with a color image-forming substance;

(3) a light-shielding agent-containing alkali processing composition; and (4) a cover sheet comprising at least a layer having a neutralizing function on a transparent support; wherein the cover sheet is characterized by having a dye-trapping layer comprising a mordant agent in a binder adjacent the alkali processing composition. The color diffusion transfer photographic film unit may be referred to simply as a "film unit" hereinafter.

DETAILED DESCRIPTION OF THE INVENTION

As one preferred embodiment of the present invention, the film unit comprises: (1) a support further having a light reflecting function in itself and/or having thereon a layer having a light-reflecting function; (2) a light-sensitive element comprising in order from said support at least: (a) a color image-receiving layer comprising a mordant agent in a binder, (b) a peeling layer and (c) at least one silver halide emulsion layer associated with a color image-forming substance; (3) a light-shielding agent-containing alkali processing composition; and (4) a cover sheet comprising at least a layer having a neutralizing function on a transparent support; wherein cover sheet is characterized by having a dye-trapping layer comprising a mordant agent in a binder adjacent to the alkali processing composition. In this embodiment, a layer having a light-reflecting function (including the support itself if it has a light-reflecting function by itself) is on the side of the color image-receiving layer (a) opposite the silver halide emulsion layer (c) and a layer having a light-shielding function (including the support itself if it has a light-shielding function by itself) is on the side of the layer having a light-reflecting function opposite the silver halide emulsion layer (c) or between the silver halide emulsion layer (c) and the peeling layer (b).

In this case, the dye-trapping layer is preferably the uppermost layer of the cover sheet where the processing composition may first penetrate thereinto when spread. The dye-trapping layer may or may not optionally be covered by any hydrophilic layer (for example, a gelatin layer).

As a further preferred embodiment of the present invention, the film unit comprises: (1) a support further having a light reflecting function in itself and/or having thereon a layer having a light-reflecting function; (2) a light-sensitive element comprising in order from the support at least: (a) a color image-receiving layer comprising a mordant agent in a binder, (b) a peeling layer and (c) at least one silver halide emulsion layer associated with a color image-forming substance; and (4) a transparent cover sheet comprising at least a layer having a neutralizing function on a transparent support and a dye-trapping layer comprising a mordant agent in a binder as the outermost layer on the same side of the transparent support as the layer having a neutralizing function, and the film unit still has a light-shielding agent-containing alkali processing composition (3) to be spread between the outermost layer of the light-sensitive element and the dye-trapping layer of the cover sheet.

In the preferred embodiments of the present invention, the film unit is exposed from the side of the transparent cover sheet (4) comprising the dye-trapping layer and then processed with a pressure means so that the alkali processing composition is uniformly spread in the inside of the film unit to initiate development of the exposed element.

After being thus processed, the part containing the support (1) and the color image-receiving layer (b) is peeled away from the other part of the film unit and, as a result, a finished print which is free from the used emulsion layer, pod and cover sheet and which is the same as a so-called conventional color print can be obtained.

In accordance with the present invention, either a transparent print or a reflecting print can be obtained.

As an another preferred embodiment of the present invention, a reflecting print is obtained by processing the film unit. In this case, the light-sensitive element having the above-mentioned light-shielding function and light-reflecting function includes the following embodiments.

(i) A light-sensitive element having at least the above-mentioned layers (a) to (c) provided on one surface of a white support and having a light-shielding layer provided on the other surface thereof.

(ii) A light-sensitive element having at least the above-mentioned layers (a) to (c) provided on one surface of a black support and having a light-reflecting layer between the support and the color image-receiving layer (a).

(iii) A light-sensitive element having at least the above-mentioned layers (a) to (c) provided on one surface of the support and having a light-reflecting layer between the support and the color image-receiving layer (a) and additionally having a light-shielding layer provided on the other surface of the support.

(iv) A light-sensitive element having at least the above-mentioned layers (a) to (c) provided on one surface of a support and having a light-reflecting layer provided between the support and the color image-receiving layer (a) and a light-shielding layer provided between the support and the light-reflecting layer.

(v) A light-sensitive element where the support itself has both a light-shielding function and a light-reflecting function as separate layers and at least the above-mentioned layers (a) to (c) are provided on the support on the side having a white light-reflecting function.

(vi) A light-sensitive element having at least the above-mentioned layers (a) to (c) provided on one surface of a white support and having a light-reflecting layer between the layer (b) and the layer (c).

(vii) A light-sensitive element having at least the above-mentioned layers (a) to (c) provided on one surface of a support and having a light-reflecting layer provided between the support and the color image-receiving layer (a) and a light-shielding layer provided between the layer (b) and the layer (c).

As a further embodiment of the present invention, a transparent print is obtained by processing the film unit. In this case, the light-sensitive element employable in the film unit includes the following embodiments.

(viii) A light-sensitive element having at least the above-mentioned layers (a) to (c) provided on one surface of a transparent support and having a light-shielding layer, which is removable after processing, provided on the other surface thereof.

(ix) A light-sensitive element having at least the above-mentioned layers (a) to (c) provided on one surface of a transparent support and having a light-shielding layer provided between the peeling layer (b) and the silver halide emulsion layer (a).

In the preferred embodiments, the distance between the color image-receiving layer and the silver halide emulsion layer containing the color image-forming substance which is nearest to the color image-receiving layer is 5 μm or less, more preferably 3 μm or less. This is because the distance for diffusing the dye as formed from the color image-forming substance to the color image-receiving layer is decreased so as to shorten the time necessary for forming the final image in the film unit. Accordingly, the preferred constitution for this purpose does not contain any light-shielding layer between the color image-receiving layer and the silver halide emulsion layer containing the color image-forming substance. Specifically, the above-mentioned embodiments (i), (ii), (iii) and (v) are particularly preferred.

By shortening the distance between the color image-receiving layer and the color image-forming layer, the above-mentioned value (D) may thereby be reduced and the ratio of (D')/(D) may accordingly be enlarged. As mentioned above, (D) is the distance between the dye formed from the color image-forming substance associated with the silver halide emulsion layer which is nearest to the color image receiving layer and the position of the color image-receiving layer to which the thus formed dye is to be directly diffused; and (D') is the distance between the dye formed from the color image-forming substance associated with the silver halide emulsion layer which is most remote from the color image-receiving layer and the position of the color image-receiving layer to which the thus formed dye is to be directly diffused.

The embodiment (i) is especially preferred.

Regarding the dye-trapping layer of the present invention, a similar concept of a scavenger mordant layer is disclosed in JP-A-50-142233 corresponding to U.S. Pat. No. 3,930,864. Precisely, it mentions a photographic constitution where a scavenger mordant layer is on a support on the side having an alkali processing composition and an emulsion layer and a color image-receiving layer is on the same support on the side opposite to the side having both layers, and the scavenger mordant layer may be in a timing layer or may be positioned after the timing layer with respect to the alkali processing composition layer. However, the constitution of JP-A-50-142233 is different from the constitution of the present invention. Specifically, the scavenger mordant layer in the constitution of JP-A-50-142233 is characteristically in the timing layer or is characteristically positioned after the timing layer with respect to the alkali processing composition layer, basically for the purpose of scavenging the undesired reaction products formed by processing or the excess dyes after a determined period of time, preferably 20 to 30 seconds. By using the scavenger mordant layer, JP-A-50-142233 states that the effects of the temperature-dependent variation of Dmax is reduced, the time-dependent variation of Dmax is also reduced (or that is, the variation of Dmax during the period of four weeks from the completion of the processing is reduced), and additionally where a diffusive color image-forming substance such as an oxychromic developing agent is initially employed, formation of the excess dye in the image-receiving layer may be retarded without delay of the access time.

However, in the preferred embodiment of the example of JP-A-50-142233, the distance (D) of directly diffusing the dye as formed from the color image-forming substance as associated with the silver halide emulsion layer which is nearest to the color image-receiving layer is relatively long because of the existence of a titanium oxide layer and a carbon black layer therebetween so that the ratio of (D')/(D) is to be smaller than that in the case of the present invention. The difference in the value (D) and the ratio (D')/(D) between the invention of JP-A-50-142233 and the present invention is absolute. In particular, in the example of JP-A-50-142233, the timing of from 20 to 30 seconds is indispensable before expression of the scavenger function. JP-A-50-142233 positively mentions that if such timing is neglected, diffusion of the dye formed into the image-receiving layer would be interfered with. As opposed to this, however, the present invention is ineffective if such timing as in JP-A-50-142233 is applied thereto, as so demonstrated in the examples to follow.

Specifically, the dye-trapping layer of the present invention is characterized by direct contact with the light-shielding agent-containing alkali processing composition, whereby the developability is enhanced, the sharpness is improved, the time for completing the final image is shortened and the variation of the color balance is reduced. Achievement of such great effects in the present invention without any fatal problem is because of the enlarged ratio of (D')/(D).

On the other hand, color diffusion transfer photographic film units having two dye-receiving layers or two dyable layers are described in the above-mentioned JP-A-50-142233 and also in JP-B-57-58650 (the term "JP-B" as used herein means an "examined Japanese patent publication") and U.S. Pat. No. 3,620,731. JP-B-57-58650 mentions a color diffusion transfer photographic film unit where a dyable layer is provided on each of two transparent supports.

However, as is illustrated in the example of JP-B-57-58650, the preferred embodiment does not have any peeling layer but it contains a light-reflecting white layer provided between the first dyable layer and the light-sensitive silver halide layer associated with a color image-forming substance provided on the first support and additionally contains a light-shielding layer. In addition, in the preferred embodiment, a white pigment is incorporated into the alkali developing composition whereby both dyable layers may give reflecting prints which can be observed through the supports. On this point, the constitution of the preferred embodiment is quite different from that of the present invention.

U.S. Pat. No. 3,620,731 mentions a color diffusion transfer photographic film unit which employs a color image-forming substance capable of releasing a dye by intramolecular ring-closure and which has two color image-receiving layers for obtaining two color images. However, it is silent on the technique of stabilizing the image after the image-having film has been peeled, or it does not mention at all the technique of providing a neutralizing layer or the technique of light-shielding. Additionally the color image-forming substance to be employed in U.S. Pat. No. 3,620,731 is quite different from that to be employed in the present invention.

In the film unit of the present invention, where the color image in the image-receiving layer is made satisfactory, or that is, the image is made to have a sufficient color density, a preferred color balance, a sufficiently low minimum density and a preferred gradation, the dye-trapping layer would give an extremely poor image. Accordingly, the dye-trapping layer of the present invention substantially does not have the function as an image-receiving layer but merely functions as a layer for realizing unexpected effects such as acceleration of the development, shortening of the image-completing time, improvement of the sharpness and reduction of the fluctuation of color balance.

Prior to the present invention, the technique of employing a peeling layer for the purpose of removing the used emulsion layer and the cover sheet was disclosed in some other patent publications. However, all of the disclosures are quite different from the characteristic constitution of the present invention, which is characterized by the neutralizing function, the light-shielding function, the light-reflecting function, the peeling layer and the dye-trapping layer as mentioned above.

JP-A-47-8237 (U.S. Pat. No. 3,730,718), JP-A-59-220727 (U.S. Pat. No. 4,499,174) and JP-A-59-229555 (U.S. Pat. No. 4,459,346) mention techniques of overcoming the defect of non-peeling combined film units or of reducing the thickness of the processed prints. Specifically, they mention a film unit having an image-receiving layer, a peeling layer and a light-sensitive layer provided in order on a support, and after being processed, the unnecessary parts of the light-sensitive layer, processing solution and cover sheet are removed from the image-having print. However, the prints to be obtained from all of the film units disclosed therein are such that the color image on the image-receiving layer is to be observed through the transparent support. In this case, therefore, the image quality of the print obtainable from the film unit is inferior to that of the print obtainable from the film unit of the present invention since the color saturation degree would be lowered because of the surface reflection of the transparent support and the whiteness degree of the white reflecting layer would be insufficient.

JP-A-56-65133 (U.S. Pat. No. 4,328,301), *Research Disclosure* Item No. 16462 (issued on December, 1977), U.S. Pat. No. 3,658,524 and British Patent 641,355 mention a technique of providing a color image-receiving layer, a peeling layer and a light-sensitive layer in order on a support (including a paper support) to give a film unit and of obtaining a color print therefrom by peeling the light-sensitive layer from the processed unit. However, these references are silent as to the technical concept of a so-called combined film unit where all of the photographic procedures from development to stabilization are effected in the film unit. Precisely, JP-A-56-65133 discloses the technique of dipping the photographic material in a processing bath and then the light-sensitive layer is peeled while wet. *Research Disclosure*, Item No. 16462 (issued on December, 1977, Vol. 164) mentions the technique of developing the light-sensitive element by uniformly spreading a viscous processing liquid thereover and thereafter peeling the element in water to finally give a photographic print. Accordingly, both of these techniques relate to photographic materials to be processed with a processing bath. This is obvious from the fact that the photographic materials do not have a layer having a development-terminating function or a layer having a neutralizing function. Since the photographic materials do not have any neutralizing function, they could not give any stable color images if they are not stabilized in a stabilizing bath. On the other hand, if the photographic materials are to be subjected to such stabilization, they would lose the intrinsic function of a so-called instant film unit.

The materials referred to in *Research Disclosure*, Item No. 16462 are those to be processed in a dark room and these could not be processed under daylight conditions.

JP-A-45-24075 (U.S. Pat. No. 3,445,228), British Patent 641,355 and U.S. Pat. Nos. 3,227,550 and 3,227,552 mention color diffusion transfer photographic materials having a color developing agent and a peeling layer therein. U.S. Pat. No. 3,445,228 mentions providing an acid-neutralizing layer between the color image-receiving layer and the support. However, all the techniques mentioned in the patent publications employ a color image-forming means which is quite different from that of the present invention, and the image quality of the color prints obtainable by the disclosed techniques is unsatisfactory.

In accordance with the present invention, a dye-forming compound which may release a diffusive dye by a redox reaction or which may vary the diffusibility of itself may be associated with a black-and-white developing agent as an electron-transferring agent. As opposed to this, in the image-forming method disclosed in the above-mentioned patent publications, a color developing agent is employed for the purpose of forming a dye. However, since the color developing agent employed is to remain in the color image-receiving layer to cause extreme stains therein, prints with a clean white background could not be obtained. Additionally, U.S. Pat. No. 3,227,550 is silent on the technique of processing the photographic materials under daylight conditions.

U.S. Pat. No. 4,401,746 mentions a combined film unit having a color image-receiving layer, a peeling layer and a light-sensitive layer provided in order on a support (including a paper support), and after being processed, the unnecessary light-sensitive layer and processing solution are removed from the processed film unit. Additionally, it suggests providing an acid-neutralizing layer between the support and the color image-receiving layer. However, the film unit illustrated in the U.S. patent specification is one to be processed in a dark room, and the specification is silent on the use of a light-shielding function in the film unit. Accordingly, the illustrated film unit is different from the film unit of the present invention which is processable under daylight conditions. Additionally the former does not satisfy the intrinsic function of a so-called instant film unit.

JP-A-49-4653 (U.S. Pat. No. 3,820,999), U.S. Pat. No. 3,220,835, JP-B-49-4334 (British Patent 1,360,653) and U.S. Pat. Nos. 2,759,825, 2,614,926, 2,543,181 and 3,409,430, mention the technique of a film unit having peeling layer, where the unnecessary light-sensitive layer is to be pealed from the processed film unit. However, all of the photographic materials employed therein are black-and-white photographic materials for a silver salt diffusion transfer process and are therefore different from the color diffusion transfer photographic materials to be employed in the film unit of the present invention. On the other hand, U.S. Pat. Nos. 4,359,518, 3,674,482 and 4,383,022 mention the combination of an additive color photographic material and a peeling layer, using a silver salt diffusion transfer process. However, all of the disclosed techniques are quite different from the present invention which uses a dye-forming compound, and additionally, the patent publications do not suggest providing a layer having a neutralizing function in the film units. Furthermore, these references are silent on the daylight-processable film units like those of the present invention.

Accordingly, the object of the present invention could not be attained by the prior art techniques. The invention is the first which provides daylight-processable film units having an excellent handlability and providing prints of high image quality with no unnecessary parts.

In accordance with the present invention, a layer having a neutralizing function is combined with the cover sheet whereby the above-mentioned problems on the quality of the film near the color image-receiving layer can be overcome. The pH-lowering procedure in the neutralizing function-having layer is especially preferably in the form of a reverse S-shape.

The "reverse S-shape pH-lowering procedure" as referred to herein means that a high pH value is maintained from immediately after spreading of the processing solution to just before peeling (just before completion of image formation), or that is, the pH lowering is restricted to fall within the range of one unit or less, while the pH value is rapidly lowered after completion of image formation, or that is, the pH value is lowered at a lowering speed of 0.5 unit or more per minute, so that the pH value is within a stable range when the image-having element is peeled from the processed film unit.

In processing the film unit of the present invention, since the neutralization step is effected in accordance with the reverse S-shape pH-lowering procedure, the pH value in the processing system may be kept high just before peeling, and therefore the image-forming speed may be hastened. In addition, since the pH value in the system is sufficiently lowered during peeling, the image sharpness is extremely improved and the safety of the processed film against contact with hands may be improved and, additionally, generation of stains and discoloration of the color image in the print during storage thereof may be prevented.

As mentioned above, in accordance with the present invention, there is provided a color diffusion transfer photographic film unit which is processable under daylight conditions and which gives a color print of high image quality. The color print obtainable from the film unit of the present invention does not have any unnecessary parts and may be handled with ease, and additionally, the film quality of the print is excellent.

The dye-trapping layer to be in the film unit of the present invention contains a mordant agent in a binder or hydrophilic colloid, like the color image-receiving layer which will be discussed in detail hereinunder. As the mordant agent to be employed in the dye-trapping layer, the same mordant agent as that to be employed in the color image-receiving layer to be discussed below can be utilized.

Among these mordant agents, those which hardly move from the mordant layer to other layers are preferred. For instance, mordant agents which are cross-linkable with the matrix such as gelatin, water-insoluble mordant agents and aqueous sol-type (or latex dispersion-type) mordant agents are preferred. Especially preferred are latex dispersion-type mordant agents, and those having a grain size of from 0.01 to 2 μm, particularly from 0.05 to 0.2 μm, are more preferred.

The mordant agent to be in the dye-trapping layer may be the same as or different from the mordant agent to be in the color image-receiving layer. Because of the mordanting capacity of the mordant agent in the dye-trapping layer, the amount of the dye to be trapped by the layer is controlled so that the image quality of the color image to be formed on the image-receiving layer may accordingly be varied.

As the binder or hydrophilic colloid for the dye-trapping layer, any known substances such as gelatin, polyvinyl alcohol and modified products thereof, polyvinyl pyrrolidone or polyacrylamide can be employed. Especially preferred is gelatin.

The amount of the dye-trapping layer to be coated may freely be defined in accordance with the photographic system of the film unit but, in general, the amount of the mordant agent in the layer is from 0.1 $g/m^2$ to 10 $g/m^2$, preferably from 0.2 $g/m^2$ to 3 $g/m^2$, more preferably from 0.2 $g/m^2$ to 1.5 $g/m^2$, and the amount of the binder or hydrophilic colloid therein is from 0.1 g/m$^2$ to 10 g/m$^2$, preferably from 0.2 g/m$^2$ to 3 g/m$^2$, more preferably from 0.2 g/m$^2$ to 1.5 g/m$^2$.

As is so demonstrated in the examples to follow hereinunder, the image quality and the color density of the color image to be formed on the image-receiving layer can be controlled on the basis of the relationship between the kind and amount of the mordant agent in the image-receiving layer and the kind and amount of the mordant agent in the dye-trapping layer. In general, it is preferred that the amount of the mordant agent in the dye trapping layer is less than that of the mordant agent in the image-receiving layer.

Next, the respective constitutional elements of the film unit of the present invention will be discussed in detail.

(A) Support for Liqht-Sensitive Element:

The support to be employed in the present invention may be an ordinary photographic support having a smooth surface, such as a general transparent support, white support or black support.

As the transparent support, a film of polyethylene terephthalate, cellulose acetate or polycarbonate having a thickness of from 50 to 350 μm, preferably from 70 to 210 μm, may be employed. The transparent support may contain a slight cloudable amount of a pigment such as titanium dioxide or a slight amount of a dye for the purpose of preventing light-piping.

The white support employable in the present invention may be any support which is white at least on the side to be coated with the color image-receiving layer and which has sufficient whiteness and surface smoothness. For instance, there are preferably mentioned a polymer film which has been whitened by the addition of fine grains of a white pigment such as titanium oxide, barium sulfate or zinc oxide, having a grain size of from 0.1 to 5 μm, or by stretching to form micro voids in the stretched film; a film of polyethylene terephthalate, polystyrene or polypropylene formed by ordinary successive biaxial-stretching; as well as a laminate of synthetic paper or natural paper prepared by laminating a titanium white-containing polyethylene, polyethylene terephthalate or polypropylene on both surfaces of the paper.

The thickness of the white support is preferably from 50 to 350 μm, more preferably from 70 to 210 μm, particularly preferably from 80 to 150 μm.

If desired, a light-shielding layer may be provided on the support. For instance, a laminate support prepared by laminating polyethylene, which contains carbon black or a similar light-shielding agent, over the back surface of a white support may be employed.

Preferred examples of the black support for use in the present invention include a film support of polyethylene terephthalate, cellulose acetate, polycarbonate, polystyrene or polypropylene containing a light-shielding agent such as carbon black and having a thickness of from 50 to 350 μm, preferably from 70 to 210 μm, and a laminate support prepared by laminating polyethylene, polyethylene terephthalate or polypropylene over both surfaces of a paper support containing a light-shielding agent such as carbon black and having a thickness of from 50 to 400 μm, preferably from 70 to 250 μm.

As the material of carbon black employable in the above-mentioned support, any carbon black prepared by known methods, such as the channel method, the thermal method or the furnace method, as described in Donnel Voest, *Carbon Black*, Marcel Dekker, Inc. (1976) can be utilized. The grain size of the carbon black to be employed in the present invention is not specifically limited but is preferably from 90 to 1,800 Å. The amount of the black pigment to be employed as a light-shielding agent can properly be determined in accordance with the sensitivity of the photographic material to be shielded from light, and preferably the optical density is approximately from 5 to 10.

Where a black support is employed or the whiteness degree of the white support employed is insufficient, it is necessary to provide a white light-reflecting layer between the support and the color image-receiving layer. For this, it is recommended to provide a layer containing fine grains of a white pigment such as titanium oxide, barium sulfate or zinc oxide having a grain size of from 0.1 to 5 μm or containing a hollow polymer latex.

In accordance with the present invention, the above-mentioned white support is preferably employed, and in particular, a white polyethylene terephthalate film support containing titanium oxide is more preferred.

(B) Color Image-Receiving Layer:

The color image-receiving layer to be employed in the present invention contains a mordant agent in a binder or hydrophilic colloid. This may be composed of a single layer or may have a multi-layer constitution where plural layers each contain a different mordant agent having a different mordant capacity are laminated. Examples of such a constitution are described in JP-A-61-252551. As the mordant agent to be in the layer, polymer mordants are preferred.

The polymer mordants to be employable in the present invention are those having a molecular weight of 5,000 or more, especially preferably 10,000 or more, and include, for example, secondary or tertiary amino group-containing polymers, nitrogen-containing hetero-ring moiety-having polymers, as well as quaternary cationic group-containing polymers thereof.

For instance, there are mentioned vinylpyridine polymers and vinylpyridinium polymers described in U.S. Pat. Nos. 2,548,564, 2,484,430, 3,148,061 and 3,756,814; vinylimidazolium cation polymers described in U.S. Pat. No. 4,124,386; polymer mordants which are cross-linkable with gelatin, as described in U.S. Pat. Nos. 3,625,694, 3,859,096 and 4,128,538 and British Patent 1,277,453; aqueous sol mordants described in U.S. Pat. Nos. 3,958,995, 2,721,852, 2,798,063, JP-A-54-115228, JP-A-54-145529, JP-A-54-126027, JP-A-54-155835 and JP-A-56-17352; water-insoluble mordants described in U.S. Pat. No. 3,898,088; reactive mordants which can react with dyes by covalent bonding, as described in U.S. Pat. Nos. 4,168,976 and 4,201,840; as well as mordants described in U.S. Pat. Nos. 3,709,690, 3,788,856, 3,642,482, 3,488,706, 3,557,066, 3,271,147, 3,271,148, JP-A-53-30328, JP-A-52-155528, JP-A-53-125, JP-A-53-1024, JP-A-53-107835 and British Patent 2,064,802.

In addition, these are further mentioned mordants described in U.S. Pat. Nos. 2,675,316 and 2,882,156.

Among these mordant agents, those which hardly move from the mordant layer to other layers are preferred. For instance, mordant agents which are cross-linkable with the matrix such as gelatin, water-insoluble mordant agents and aqueous sol-type (or latex dispersion-type) mordant agents are preferred. Especially preferred are latex dispersion-type mordant agents, and those having a grain size of from 0.01 to 2 μm, particularly from 0.05 to 0.2 μm, are more preferred.

The amount of the mordant agent to be coated varies in accordance with the kind of the mordant agent, the content of the quaternary cationic groups in the mordant agent, the kind and amount of the dye to be mordanted with the agent as well as the kind of the binder to be used, but it may be from 0.5 to 10 g/m$^2$, preferably from 1.0 to 5.0 g/m$^2$, especially preferably from 2 to 4 g/m$^2$.

As the binder or hydrophilic colloid to be used in the image-receiving layer, gelatin, polyvinyl alcohol, polyacrylamide and polyvinyl pyrrolidone can be employed. Especially preferred is gelatin among them.

The amount of the binder or hydrophilic colloid is generally from 0.5 to 10 g/m$^2$, and preferably from 1.0 to 5.0 g/m$^2$.

(C) Light-Shielding Layer:

In the constitution of the film unit of the present invention, the light-sensitive layer is completely shielded from any external light during development procedures by the function of the light-shielding layer in the light-sensitive element and the light-shielding processing liquid to be spread over the light-sensitive element during processing, and therefore, the film unit of the present invention is processable under daylight conditions. Precisely, a light-shielding agent-containing layer is provided on the back surface of the support or between the emulsion layer and the support; or alternatively, a light-shielding agent-containing layer may be incorporated into the support.

As the light-shielding agent for this purpose, any agent having a light-shielding function may be employed. Especially preferred is carbon black. The amount of carbon black as the light-shielding agent is generally from 1.0 to 5.0 g/m$^2$, and preferably from 1.5 to 3.0 g/m$^2$.

As the binder to be used with the light-shielding agent in combination, any binder which can disperse carbon black therein can be used. Preferably, it is gelatin. The amount of the binder is generally from 0.5 to 5.0 g/m$^2$, are preferably 0.5 to 3.0 g/m$^2$.

(D) Peeling Layer:

In the constitution of the film unit of the present invention, a peeling layer is provided between the emulsion layer which is associated with a color image-forming substance and the color image-receiving layer, and the peeling layer is peeled away after processing. Accordingly, the peeling layer must be such that it has a function of firmly combining the image-receiving layer and the emulsion layer in the non-processed state but may easily be peeled away from the processed unit. As the material for the peeling layer, for example, those described in JP-A-47-8237, JP-A-59-20727, JP-A-59-229555, JP-A-49-4653, U.S. Pat. Nos. 3,220,835, 4,359,518, JP-B-49-4334 (British Patent 1,360,653), JP-A-56-65133, JP-A-45-24075, U.S. Pat. Nos. 3,227,550, 2,759,825, 4,401,746 and 4,366,227 can be employed. As one specific example of the material, there are mentioned water-soluble (or alkali-soluble) cellulose derivatives. Such derivatives include, for example, hydroxyethyl cellulose, cellulose acetate phthalate, plasticized methyl cellulose, ethyl cellulose, cellulose nitrate and carboxymethyl cellulose. As other examples, there are further mentioned various kinds of natural high polymers such as alginic acid, pectin and gum arabic. Additionally, various modified gelatins such as acetylated gelatin or phthalated gelatin can also be employed. As further examples, there are mentioned water-soluble synthetic polymers. Such polymers include, for example, polyvinyl alcohol, polyacrylate, polymethyl methacrylate, polybutyl methacrylate as well as copolymers thereof.

The peeling layer may be a single layer or may be composed of plural layers. Examples of the layer are described in JP-A-59-220727 and JP-A-60-60642.

As further examples of the peeling layer, which are especially preferably employable in the present invention, those described in JP-A-1-198748, JP-A-1-97750, Japanese Patent Application Nos. 63-155924, 63-6859, 63-76860 and 63-76861 are referred to.

(E) Light-Sensitive Layer:

In the constitution of the film unit of the present invention, a light-sensitive layer comprising a silver halide emulsion layer(s) associated with a color image-forming substance is provided above the above-mentioned peeling layer. The elements constituting the light-sensitive layer will be mentioned hereinunder.

(1) Color Image-Forming Substance:

The color image-forming substance to be employed in the present invention is a non-diffusive compound which releases a diffusive dye (or a diffusive dye precursor) in relation to the development of silver or a compound having a diffusibility by itself which is variable in relation to development of silver, and it is described in T. H. James, *The Theory of the Photographic Process*, 4th Edition. The compound can be represented by the following general formula (I):

$$\text{DYE-Y} \qquad \text{(I)}$$

where DYE represents a dye or a dye precursor, and Y represents a component which gives a compound having a diffusibility different from that of the compound of the formula (I) under an alkaline condition. On the basis of the function of the moiety Y, the compound is classified into a negative compound which may be diffusive in the silver-developed portion and a positive compound which may be diffusive in the non-developed portion.

Preferably, the color image-forming substance for use in the present invention is a dye-releasing redox compound which itself is non-diffusive. More preferably, it is a negative dye-releasing redox compound which itself is non-diffusive.

As an example of the negative moiety Y, one which is oxidized by development and cleaved to release a diffusive dye is referred to.

Specific examples of the moiety Y are described in U.S. Pat. Nos. 3,928,312, 3,993,638, 4,076,529, 4,152,153, 4,055,428, 4,053,312, 4,198,235, 4,179,291, 4,149,392, 3,844,785, 3,443,943, 3,751,406, 3,443,939, 3,443,940, 3,628,952, 3,980,479, 4,183,753, 4,142,891, 4,378,750, 4,139,379, 4,218,368, 3,421,964, 4,199,355, 4,199,354, 4,135,929, 4,336,322, 4,139,389, JP-A-53-50736, JP-A-51-104343, JP-A-54-130122, JP-A-53-110827, JP-A-56-12642, JP-A-56-16131, JP-A-57-4043, JP-A-57-650, JP-A-57-20735, JP-A-53-69033, JP-A-54-130927, JP-A-56-164342 and JP-A-57-119345.

As the moiety Y in negative dye-releasing redox compounds, N-substituted sulfamoyl groups are especially preferred, where the N-substituent may be one derived from aromatic hydrocarbon rings or hetero rings. Specific examples of such a moiety Y are mentioned below, which, however, are not limitative.

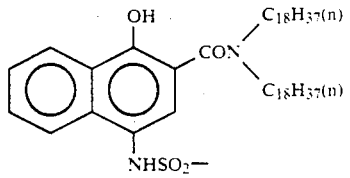

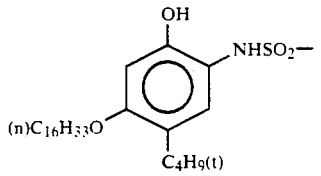

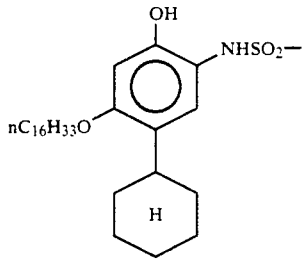

Examples of positive compound are described in *Angev. Chem. Inst. Ed. Engl.* 22, 191 (1982).

As specific examples of these compounds, those which are initially diffusive under an alkaline condition but are oxidized by development to become non-diffusive are referred to, such as color developing agents. As the moity Y which is effective for the compounds of this type, those mentioned in U.S. Pat. No. 2,983,606 are exemplified.

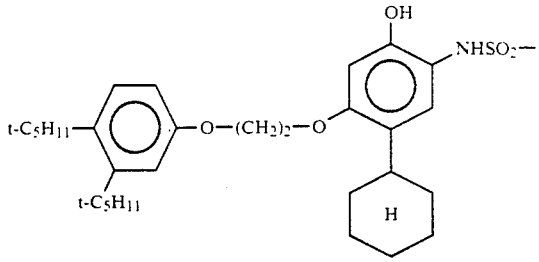

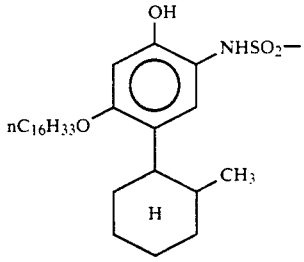

As examples of another type, compounds which may release a diffusive dye by self-ring closure under alkaline conditions but cannot substantially release any dye after being oxidized by development are referred to. Specific examples of the moiety Y which has such a function are described in U.S. Pat. No. 3,980,479, JP-A-53-69033, JP-A-54-130927 and U.S. Pat. Nos. 3,421,964 and 4,199,355.

As examples of still another type, compounds which do not release a dye by themselves but which may release a dye after being reduced are referred to. Compounds of this type are employed in combination with an electron-donating substance, whereby they may imagewise release a diffusive dye by reaction with the electron-donating substance and still remain even after imagewise oxidation by development of silver. Atomic groups having such a function are described in, for example, U.S. Pat. Nos. 4,183,753, 4,142,391, 4,278,750, 4,139,379, 4,218,368, JP-A-53-110827, U.S. Pat. Nos. 4,278,750, 4,356,249, 4,358,525, JP-A-53-110827, JP-A-54-130927, JP-A-56-164342, Kokai Giho (Disclosure Bulletin) 87-6199, and European Patent 220746A2.

Specific examples of the groups are mentioned below, which, however, are not limitative.

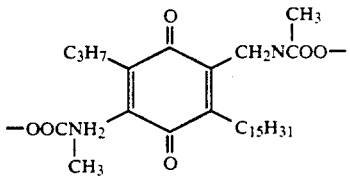

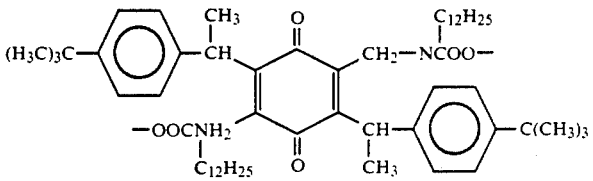

-continued

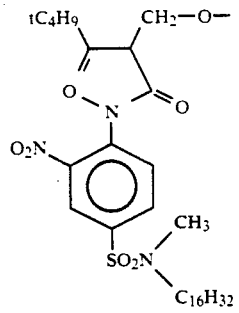

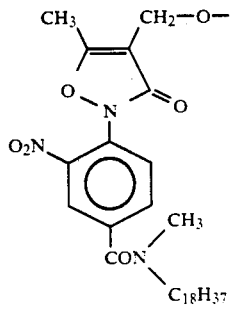

The compounds of this type are preferably employed in combination with non-diffusive electron-donating compounds (which are well known as ED compounds) or precursors thereof. Examples of ED compounds are described in, for example, U.S. Pat. Nos. 4,263,393, 4,278,750 and JP-A-56-138736.

As further examples of color image-forming substances of another type, the following compounds can also be employed in the present invention.

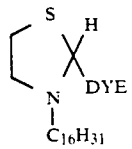

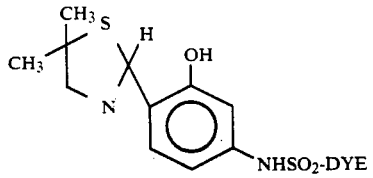

In the formulae, DYE represents a dye or dye precursor, which has the same meaning as mentioned above.

The details of these compounds are described in U.S. Pat. Nos. 3,719,489 and 4,098,783.

Specific examples of the dyes represented by the moiety DYE in the above-mentioned general formulae are mentioned in the following patent publications or literatures.

Examples of Yellow Dyes:

These are described in U.S. Pat. Nos. 3,597,200, 3,309,199, 4,013,633, 4,245,028, 4,156,609, 4,139,383, 4,195,992, 4,148,641, 4,148,643, 4,336,322; JP-A-51-114930, JP-A-56-71072; and *Research Disclosure*, Item Nos. 17630 (1978) and 16475 (1977).

Examples of Magenta Dyes:

These are described in U.S. Pat. Nos. 3,453,107, 3,544,545, 3,932,380, 3,931,144, 3,932,308, 3,954,476, 4,233,237, 4,255,509, 4,250,246, 4,142,891, 4,207,104, 4,287,292; JP-A-52-106727, JP-A-53-23628, JP-A-55-36804, JP-A-56-73057, JP-A-56-71060, JP-A-55-134.

Examples of Cyan Dyes:

These are described in U.S. Pat. Nos. 3,482,972, 3,929,760, 4,013,635, 4,268,625, 4,171,220, 4,242,435, 4,142,891, 4,195,994, 4,147,544, 4,148,642; British Patent 1,551,138; JP-A-54-99431, JP-A-52-8827, JP-A-53-47823, JP-A-53-143323, JP-A-54-99431, JP-A-56-71061; European patents 53,037, 53,040; *Research Disclosure*, Item Nos. 17630 (1978) and 16475 (1977).

(2) Silver Halide Emulsion:

The silver halide emulsion to be employed in the present invention may be either a negative emulsion which forms a latent image essentially on the surfaces of silver halide grains or an internal latent image type direct positive emulsion which forms a latent image essentially in the inside of the silver halide grains.

The internal latent image type direct positive emulsion includes, for example, a so-called "conversion type" emulsion which is prepared by utilizing the difference in the solubility of silver halides and a "core/shell type" emulsion which is prepared by coating at least the light-sensitive site of the core grain of a silver halide as doped with a metal ion and/or chemically sensitized with a shell of a different silver halide. These are described in U.S. Pat. Nos. 2,592,250, 3,206,313; British Patent 1,027,146; U.S. Pat. Nos. 3,761,276, 3,935,014, 3,447,927, 3,497,875, 3,563,785, 3,551,662, 4,395,478; West German Patent 2,728,108; and U.S. Pat. No. 4,431,730.

Where the internal latent image type direct positive emulsion is employed, it is necessary to give fogged nuclei to the surfaces of the grains by applying light thereto after imagewise exposure or by the use of a nucleating agent.

Examples of the nucleating agent employable for the purpose include hydrazines described in U.S. Pat. Nos. 2,563,785 and 3,588,982; hydrazides and hydrazones described in U.S. Pat. No. 3,227,552; heterocyclic quaternary salt compounds described in British Patent 1,283,835, JP-A-52-69613, U.S. Pat. Nos. 3,615,615, 3,719,494, 3,734,738, 4,094,683 and 4,115,122; sensitizing dyes having a nucleating substituent in the dye molecule, as described in U.S. Pat. No. 3,718,470; thiourea bond-containing acylhydrazine compounds described in U.S. Pat. Nos. 4,030,923, 4,031,127, 4,245,037, 4,256,511, 4,266,913, 4,276,364, and British Patent 2,012,443; as well as acylhydrazine compounds having an adsorbing group derived from thioamide rings or heterocyclic rings such as triazoles or tetrazoles, as described in U.S. Pat. Nos. 4,080,270, 4,278,748 and British Patent 2,011,391B.

In accordance with the present invention, color sensitizing dyes are employed in combination with the above-mentioned negative emulsions or internal latent image type direct positive emulsions. Specific examples of color sensitizing dyes usable in the present invention are described in JP-A-59-180550 and JP-A-60-140335; *Research Disclosure*, Item No. 17029; U.S. Pat. Nos. 1,846,300, 2,078,233, 2,089,129, 2,165,338, 2,231,658, 2,917,516, 2,352,857, 3,411,916, 2,295,276, 2,481,698, 2,688,545, 2,921,067, 3,282,933, 3,397,060, 3,660,104, 3,335,010, 3,352,680, 3,384,486, 3,623,881, 3,718,470, and 4,025,349.

(3) Constitution of Light-Sensitive Layer:

For reproduction of natural colors by subtractive color photography, at least two light-sensitive layers each composed of an emulsion color-sensitized with the above-mentioned color sensitizing dye and the above-mentioned color image-forming substance capable of giving a dye having a selective spectral absorption in the same wavelength range are employed. The emulsion and the color image-forming substance may be coated separately in different layers, or alternatively, they may be blended and coated to form one layer. Where the color image-forming substance coated has an absorption in the color-sensitive range of the emulsion combined therewith, it is preferred that the two are separately coated as different layers. The emulsion layer may be composed of plural layers each having a different sensitivity. If desired, any interlayer may be provided between the emulsion layer and the color image-forming substance layer. For instance, a nucleating and development accelerator-containing layer (e.g., described in JP-A-60-173541) or a partition layer (e.g., described in JP-B-60-15267) may be provided between the two layers so as to elevate the density of the color image to be formed, or a reflecting layer (e.g., described in JP-A-60-91354) may be provided therebetween so as to elevate the sensitivity of the light-sensitive element As the preferred multi-layer constitution for the light-sensitive layer of the present invention, a combination unit of a blue-sensitive emulsion, a combination unit of a green-sensitive emulsion and a combination unit of a red-sensitive emulsion are arranged in order from the side to be exposed.

If desired, any optional layer may be provided between the respective emulsion layer units. In particular, an interlayer (intermediate layer) is preferably provided therebetween so as to prevent any unfavorable influence of the effect of development of a certain emulsion layer to the other emulsion layers.

Where a developing agent is associated with the non-diffusive color image-forming substance in the emulsion layer unit, the interlayer, if any, is preferred to contain a non-diffusive reducing agent for the purpose of preventing diffusion of the oxidation product of the developing agent. Specifically, non-diffusive hydroquinones, sulfonamidophenols and sulfonamidonaphthols are employed as the reducing agent. Specific examples of the compounds are described in JP-B-50-21249, JP-B-50-23813, JP-A-49-106329, JP-A-49-129535, U.S. Pat. Nos. 2,336,327, 2,360,290, 2,403,721, 2,544,640, 2,732,300, 2,782,659, 2,937,096, 3,637,393, 3,700,453, British Patent No. 557,750, JP-A-57-24941, and JP-A-58-21249. The means for dispersing the compounds are described in JP-A-60-238831 and JP-B-60-18978.

Where compounds which release a diffusive dye by the action of a silver ion, such as those described in JP-B-55-7576, are employed, it is preferred to incorporate a compound of a trapping silver ion in the interlayer.

If desired, the constitution of the light-sensitive layer may further contain an anti-irradiation layer, a separating layer and a protective layer.

(F) Processing Composition:

In accordance with the present invention, the processing composition is uniformly spread over the light-sensitive element after exposure of the element. This is paired with the light-shielding layer provided on the back surface of the support or on the light-sensitive layer on the side opposite to the processing composition layer and functions to completely shield the light-sensitive layer from external light. At the same time, it also has a function of developing the light-sensitive layer because of the developing component therein. Accordingly, the composition may contain an alkali component, a tackifier, a light-shielding agent, a developing agent and additionally a development accelerator or a development inhibitor for the purpose of adjusting development and an antioxidant for the purpose of preventing deterioration of the developing agent. The composition necessarily contains a light-shielding agent.

The alkali component to be contained in the composition may be such to make the composition have a pH value of from 12 to 14. Preferably, it may be selected from alkali metal hydroxides (e.g., sodium hydroxide, potassium hydroxide, lithium hydroxide), alkali metal phosphates (e.g., potassium phosphate), guanidines and hydroxides of quaternary amines (e.g., tetramethylammonium hydroxide). Above all, potassium hydroxide and sodium hydroxide are preferred.

The tackifier is used for the purpose of uniformly spreading the processing composition over the light-sensitive element or for the purpose of maintaining firm adhesion between the light-sensitive layer and the cover sheet when the used light-sensitive layer is peeled along with the cover sheet. For instance, polyvinyl alcohol, hydroxyethyl cellulose and alkali salts of carboxymethyl cellulose are employed as the tackifier. Preferably, hydroxyethyl cellulose and sodium carboxymethyl cellulose are employed.

As the light-shielding agent, any dye or pigment or any combination thereof can be employed, provided that it does not diffuse to the dye-receiving layer to cause stains therein. One typical example of the agent is carbon black. Additionally, a combination of titanium white and a dye can also be employed. The dye for the combination may be a temporary light-shielding dye which may become colorless in a certain period of time after processing.

The developing agent may be any which may oxidize the color image-forming substance by cross-oxidation and which does not substantially cause stains after being oxidized. One or more kinds of such developing agents may be employed alone or in combination, or the developing agent can also be employed as a precursor. The developing agent may be incorporated into a pertinent layer of the light-sensitive element or may also be incorporated into the alkaline processing liquid. Specific examples of the agents include aminophenols and pyrazolidinones. For causing less stains, pyrazolidinones are preferred.

For instance, such compounds include 1-phenyl-3-pyrazolidinone, 1-p-tolyl-4,4-dihydroxymethyl-3-pyrazolidinone, 1-(3'-methylphenyl)-4-methyl-4-hydroxymethyl-3-pyrazolidinone, 1-phenyl-4-methyl-4-hydroxymethyl-3-pyrazolidinone, 1-p-tolyl-4-methyl-4-hydroxymethyl-2-pyrazolidinone.

After being processed, the cover sheet is peeled along with the processing liquid and the used light-sensitive layer. However, the cover sheet has functions of uniformly spreading the processing liquid over the light-sensitive element and of neutralizing the alkali to be carried over from the processing composition. The cover sheet must have the dye-trapping layer of the present invention. A filter dye can be incorporated into the cover sheet so as to adjust the sensitivity of the light-sensitive layer. The filter dye may directly be added to the support of the cover sheet or may be coated over the support as a separate layer.

(G) Support of Cover Sheet:

The support for the cover sheet of the present invention is a smooth and transparent support which is generally employed as photographic supports. Preferably, it is a film of polyethylene terephthalate, cellulose acetate, polystyrene or polycarbonate having a thickness of from 50 to 350 μm, preferably from 50 to 210 μm. It is preferred that the transparent support contains a slight amount of a dye or a slight cloudable amount of a pigment such as titanium dioxide, for the purpose of preventing light-piping. The transparent support preferably has a subbing layer. (H) Layer having a Neuralizinq Function:

The layer having a neutralizing function to be employed in the present invention is a layer which contains an acidic substance in a sufficient amount for neutralizing the alkali to be carried over from the processing composition. If desired, it may have a multi-layer constitution containing a neutralization speed-adjusting layer (timing layer) and an adhesion-enhancing layer. Preferred acidic substances to be used in the layer are compounds having an acidic group having a pKa value of 9 or less (or having a precursor group capable of giving such an acidic group by hydrolysis). More preferably, there are higher fatty acids such as oleic acid, as described in U.S. Pat. No. 2,983,606; polymers of acrylic acid, methacrylic acid or maleic acid, or partial esters thereof or acid anhydrides thereof, as described in U.S. Pat. No. 3,362,819; copolymers of acrylic acid and acrylate described in French Patent 2,290,699; as well as latex type acidic polymers, as described in U.S. Pat. No. 4,139,383 and Research Disclosure No. 16102 (1977).

In addition, the acidic substances described in U.S. Pat. No. 4,088,493, JP-A-52-153739, JP-A-53-1023, JP-A-53-4540, JP-A-53-4541 and JP-A-53-4542 can also be employed.

Specific examples of acidic polymers usable in the present invention include copolymers of vinyl monomer(s) such as ethylene, vinyl acetate or vinyl methyl ether and maleic anhydride, copolymers of n-butyl esters thereof or butyl acrylate and acrylic acid, as well as cellulose acetate hydrogen phthalates.

The above-mentioned polymer acids may be employed alone or in combination with other hydrophilic polymers. Such hydrophilic polymers include, for example, polyacrylamide, polymethyl pyrrolidone, polyvinyl alcohol (including partially saponified products), carboxymethyl cellulose, hydroxymethyl cellulose, hydroxyethyl cellulose and polymethyl vinyl ether. In particular, polyvinyl alcohol is preferred among them.

The above-mentioned polymer acids may also be blended with any polymers other than hydrophilic polymers, such as cellulose acetate.

The amount of the polymer acid to be coated is determined in accordance with the amount of the alkali to be developed over the light-sensitive element. The equivalent ratio of the polymer acid to the alkali per unit area is preferably from 0.9 to 2.0. If the amount of the polymer acid is too small, the color hue of the transferred dye will fluctuate, or the white background portion will be stained. On the other hand, if it is too large, the color hue will also fluctuate and the light-fastness will disadvantageously lower. More preferably, the equivalent ratio is from 1.0 to 1.3. Where the polymer acid is employed along with a hydrophilic polymer, the amount of the hydrophilic polymer to be added is to be properly controlled. If the amount of the hydrophilic polymer is too small or too large, the photographic quality will lower. Accordingly, the weight ratio of the hydrophilic polymer to the polymer acid is generally from 0.1 to 10, preferably from 0.3 to 3.0.

The layer having a neutralizing function of the present invention can contain additives for various purposes. For instance, a known hardening agent which is employed for hardening the layer as well as a polyhydroxyl compound for improving the brittleness of the layer, such as polyethylene glycol, polypropylene glycol or glycerin, can be added to the layer. In addition, an antioxidant or, a development inhibitor or a precursor thereof may also be added to the layer, if desired.

As the material for the timing layer to be used with the neutralizing layer, polymers which lower the alkali-permeability, such as gelatin, polyvinyl alcohol, partial acetalized products of polyvinyl alcohol, cellulose acetate, partially hydrolyzed polyvinyl acetate or the like; latex polymers which elevate the energy for activation of alkali-permeability and which are prepared by copolymerizing a small amount of a hydrophilic comonomer such as an acrylic acid monomer; as well as lactone ring-containing polymers are useful.

Above all, cellulose acetate-containing timing layers described in JP-A-54-136328, U.S. Pat. Nos. 4,267,262, 4,009,030 and 4,029,849; latex polymers prepared by copolymerizing a small amount of a hydrophilic comonomer such as acrylic acid, as described in JP-A-54-128335, JP-A-56-69629, JP-A-57-6843, U.S. Pat. Nos. 4,056,394, 4,061,496, 4,199,362, 4,250,243, 4,256,827 and 5,268,604; lactone ring-containing polymers described in U.S. Pat. No. 4,229,516; as well as polymers described in JP-A-56-25745, JP-A-56-97346, JP-A-57-6842, European Patent 31,957A1, 37,724A1 and 48,412A1 are especially preferred.

In addition, the substances described in U.S. Pat. Nos. 3,421,893, 3,455,686, 3,575,701, 3,778,265, 3,785,815, 3,847,615, 4,088,493, 4,123,275, 4,148,653, 4,201,587, 4,288,523, 4,297,431, West German Patent Application (OLS) Nos. 1,622,936, 2,162,277, *Research Disclosure* Item No. 15,162 No. 151 (1976) can also be employed.

As the materials for the neutralization-timing layer for leading the reverse S-shape pH-lowering procedure, there are copolymers composed of an ethylenic unsaturated monocarboxylic acid or dicarboxylic acid (e.g., acrylic acid, methacrylic acid, itaconic acid) and one or more copolymerizable ethylenic unsaturated monomers; polymers described in JP-A-59-202463; as well as substances described in U.S. Pat. Nos. 4,297,431, 4,288,523, 4,201,587, 4,229,516, JP-A-55-121438, JP-A-56-166212, JP-A-55-41490, JP-A-55-54341, JP-A-56-102852, JP-A-57-141644, JP-A-57-173824, JP-A-57-179841, West German Patent Application (OLS) No. 2,910,272, European Patent 31957A1, and *Research Disclosure*, Item No. 18452. Examples of ethylenic unsaturated monomers usable for the purpose include ethylene, propylene, 1-butene, isobutene, styrene, chloromethylstyrene, hydroxymethyl-styrene, sodium vinylbenzenesulfonate, sodium vinyl-benzylsulfonate, N,N,N-trimethyl-N-vinylbenzylammonium chloride, N,N-dimethyl-N-benzyl-N-vinylbenzylammonium chloride, α-methylstyrene, vinyltoluene, 4-vinyl-pyridine, 2-vinylpyridine, benzylvinylpyridinium chloride, N-vinylacetamide, N-vinylpyrrolidone, 1-vinyl-2-methylmimidazole, monoethylenic unsaturated esters of fatty acids (e.g., vinyl acetate, allyl acetate), maleic anhydride, esters of ethylenic unsaturated monocarboxylic acids or dicarboxylic acids (e.g., n-butyl acrylate, n-hexyl acrylate, hydroxyethyl acrylate, cyanoethyl acrylate, N,N-diethylaminoethyl acrylate, methyl methacrylate, n-butyl methacrylate, benzyl methacrylate, hydroxyethyl methacrylate, chloroethyl methacrylate, methoxyethyl methacrylate, N,N-diethylaminoethyl methacrylate, N,N,N-triethyl-N-methacryloyloxyethylammonium p-toluenesulfonate, N,N-diethyl-N-methyl-N-methacryloyloxyethylammonium p-toluenesulfonate, dimethyl itaconate, monobenzyl maleate), ethylenic unsaturated monocarboxylic acid or dicarboxylic acid amides (e.g., acrylamide, N,N-dimethylacrylamide, N-methylolacrylamide, N-(N,N-dimethylaminopropyl)acrylamide, N,N,N-trimethyl-N-(N-acryloylpropyl)ammonium p-toluenesulfonate,sodium 2-acrylamido-2-methylpropanesulfonate, acryloylpropanediamine propionate betaine, N,N-dimethyl-N'-methacryloylpropanediamine acetate betaine), etc.

Preferred examples of polymers for the neutralization-timing layer of the kind are mentioned below, which, however, are not limitative. All the polymerization ratios are by mol.

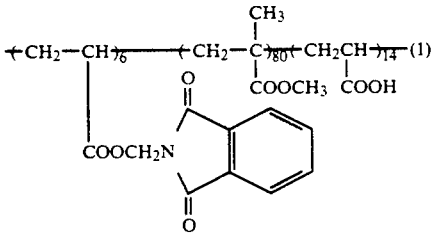

(1)

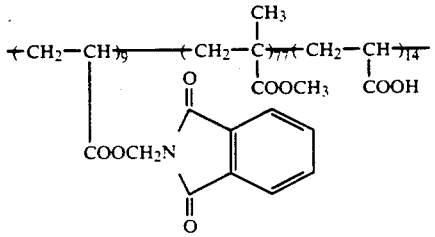

(2)

-continued

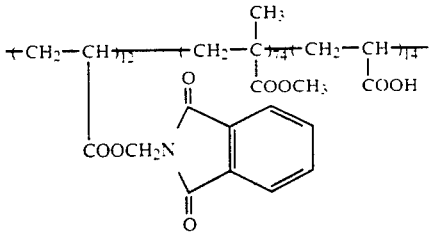

(3)

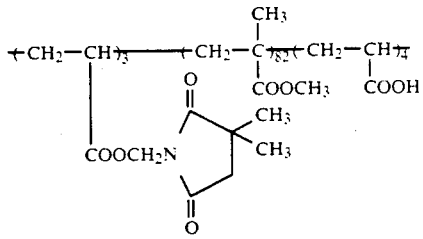

(4)

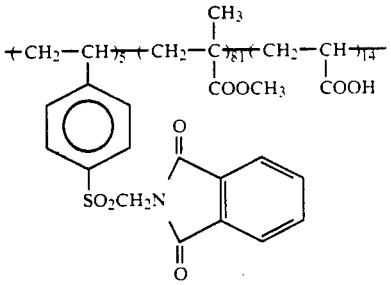

(5)

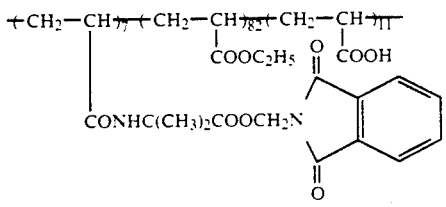

(6)

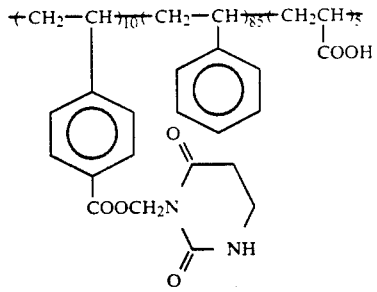

(7)

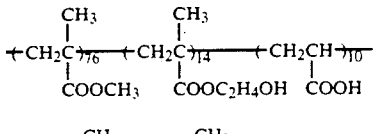

(8)

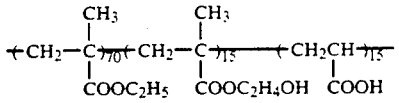

(9)

Preferred are (1) to (8); and especially preferred are (1), (2), (3) and (8).

The neutralization-timing layer may be a single layer or may have a multi-layer constitution.

The timing layer composed of the above-mentioned material can further contain, if desired, the development inhibitor and/or a precursor thereof as described in U.S. Pat. No. 4,009,029, West German Patent Application (OLS) Nos. 2,913,164, 3,014,672, JP-A-54-155837 and JP-A-55-138745, or the hydroquinone precursor as described in U.S. Pat. No. 4,201,578, or other various photographic useful additives or precursors thereof.

The film unit of the present invention is formed into a monosheet by the use of a masking agent, a rail material and excess liquid-trapping material, as described in, for example, JP-B-48-33697, JP-A-48-43317, JP-A-50-153628, JP-A-52-11027 and JP-A-56-48629.

In order to facilitate the easy peeling after processing, it is effective to provide a slit to the monosheet film unit of the present invention, as disclosed in *Research Disclosure,* Item No. 23026 (1983) The shape and depth of the slit may properly be determined in accordance with the property of the support employed.

Where the film unit of the present invention is utilized for photographing an object, it is necessary that a reflected image of the object is formed on the film. For this, it is necessary to use a mirror.

A camera usable for the purpose is known, for example, as described in U.S. Pat. No. 3,447,437. The following examples are intended to illustrate the present invention in more detail but not to restrict it in any way.

EXAMPLE 1

Image-Receiving Liqht-Sensitive Sheet (I):

The following layers (A), (B) and (C) were coated on the back surface of a titanium white pigment-containing PET support, and the following layers (1) to (22) were on the opposite surface thereof. Accordingly, an image-receiving light-sensitive sheet (I) was prepared.

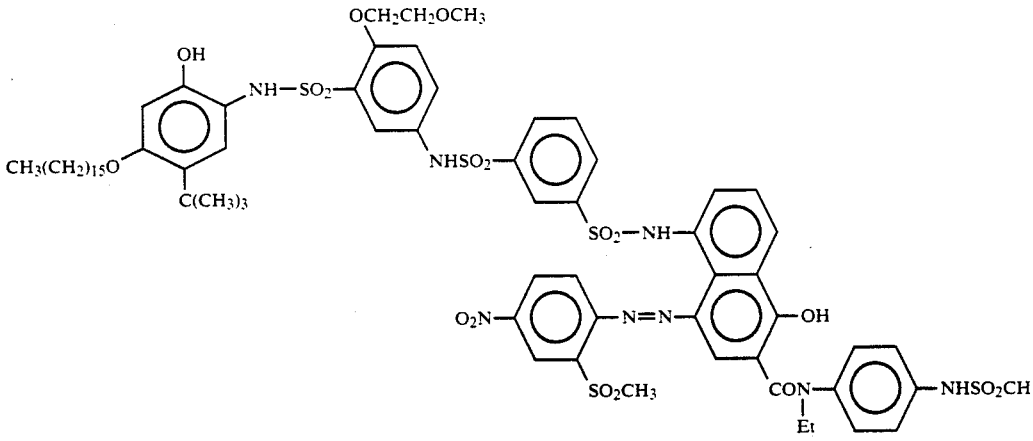

(A) Light-shielding layer containing 2.0 g/m$^2$ of carbon black and 2.0 g/m$^2$ of gelatin.

(B) White layer containing 2.0 g/m$^2$ of titanium white and 0.7 g/m$^2$ of gelatin.

(C) Protective layer containing 0.09 g/m$^2$ of polymethyl methacrylate grains-containing mat agent and 0.3 g/m$^2$ of gelatin.

(1) Mordant layer containing 3 g/m$^2$ of the following polymer latex mordant agent (polymerization ratio by mol) and 3 g/m$^2$ of gelatin.

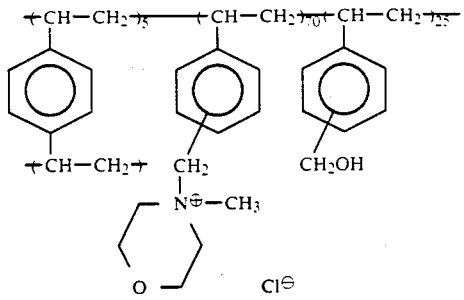

(2) First peeling layer containing 0.1 g/m$^2$ of the following compound.

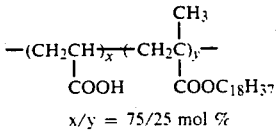

(3) Second peeling layer containing 0.2 g/m$^2$ of cellulose acetate having an acetylation degree of 51%.

(4) Layer containing 1 g/m$^2$ of ethyl acrylate latex and 2.5 g/m$^2$ of gelatin.

(5) Layer containing 0.44 g/m$^2$ of the following cyan dye-releasing redox compound, 0.09 g/m$^2$ of tricyclohexyl phosphate, 0.008 g/m$^2$ of 2,5-di-t-pentadecylhydroquinone, 0.05 g/m$^2$ of carbon black and 0.8 g/m$^2$ of gelatin.

(6) Light-reflecting layer containing 2 g/m$^2$ of titanium oxide and 0.5 g/m$^2$ of gelatin.

(7) Low-sensitive red-sensitive emulsion layer containing 0.15 g/m$^2$ (as silver) of internal latent image type direct positive silver bromide emulsion containing octahedral silver bromide grains having a grain size of 1.0 μm, the following red-sensitizing dye as in layer (8), 0.4 g/m$^2$ of gelatin, 1.1 μg/m$^2$ of the following nucleating agent (NA) and 0.02 g/m$^2$ of sodium 2-sulfo-5-n-pentadecylhydroquinone.

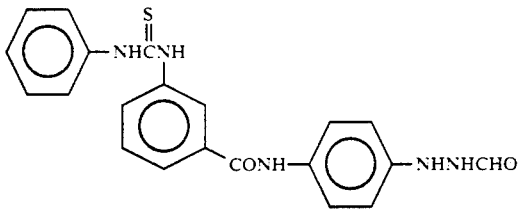

(8) High-sensitive red-sensitive emulsion layer containing 0.5 g/m$^2$ (as silver) of internal latent image type direct positive silver bromide emulsion containing octahedral silver bromide grains having a grain size of 1.6 μm, the following red-sensitizing dye, 0.8 g/m$^2$ of gelatin, 3.0 μg/m$^2$ of the same nucleating agent (NA) as that in Layer (7) and 0.04 g/m$^2$ of sodium 2-sulfo-5-n-pentadecylhydroquinone.

Red-Sensitizing Dye:

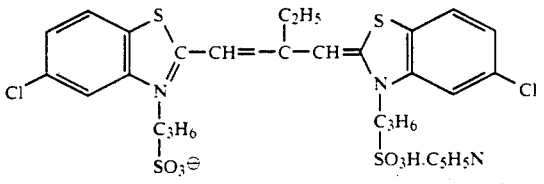

(1.4 mg per g of Ag)

(9) Color mixing preventing layer containing 1.2 g/m$^2$ of 2,5-di-t-pentadecylhydroquinone, 1.2 g/m$^2$ of polymethyl methacrylate and 0.7 g/m$^2$ of gelatin.

(10) Layer containing 0.3 g/m$^2$ of gelatin.

(11) Layer containing 0.15 g/m$^2$ of the following magenta dye-releasing redox compound, 0.1 g/m$^2$ of tricyclohexyl phosphate, 0.009 g/m$^2$ of 2,5-di-t-pentadecylhydroquinone and 0.9 g/m$^2$ of gelatin.

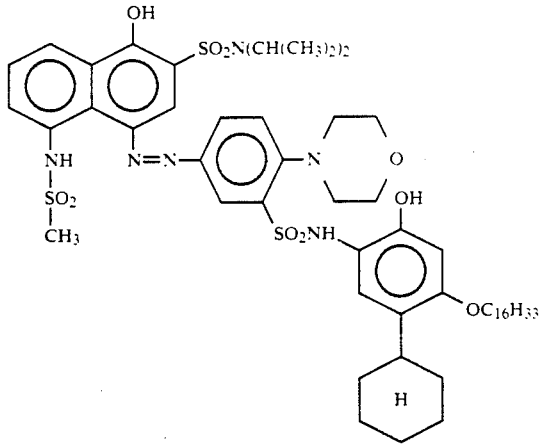

(12) Light-reflecting layer containing 1 g/m$^2$ of titanium oxide and 0.25 g/m$^2$ of gelatin.

(13) Low-sensitive green-sensitive emulsion layer containing 0.12 g/m$^2$ (as silver) of internal latent image type direct positive silver bromide emulsion containing octahedral silver bromide grains having a grain size of 1.0 m, the following green-sensitizing dyes, 0.25 g/m$^2$ Of gelatin, 1.1 μg/m$^2$ of the same nucleating agent (NA) as that in Layer (7) and 0.02 g/m$^2$ of sodium 2-sulfo-5-n-pentadecylhydroquinone.

(14) High-sensitive green-sensitive emulsion layer containing 0.35 g/m$^2$ (as silver) of internal latent image type direct positive silver bromide emulsion containing octahedral silver bromide grains having a grain size of 1.6 μm, the following green-sensitizing dyes, 0.7 g/m$^2$ of gelatin, 1.7 μpm/m$^2$ of the same nucleating agent (NA) as that in Layer (7) and 0.04 g/m$^2$ of sodium 2-sulfo-5-n-pentadecylhydroquinone.

Green-Sensitizing Dyes:

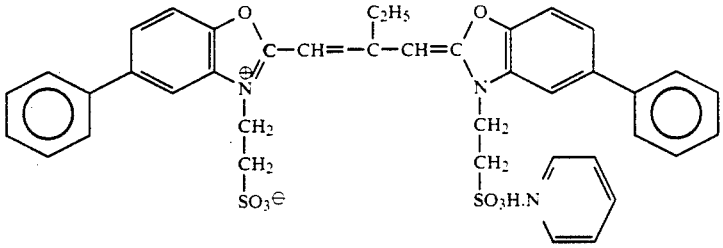

(1 mg per g of Ag)

and

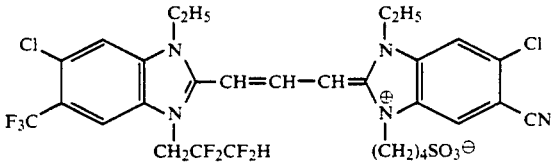

(1 mg per g of Ag)

(15) Color mixing preventing layer containing 0.8 g/m$^2$ of 2,5.di-t-pentadecylhydroquinone, 0.8 g/m$^2$ of polymethyl methacrylate and 0.45 g/m$^2$ of gelatin.

(16) Layer containing 0.3 g/m$^2$ of gelatin.

(17) Layer containing 0.53 g/m$^2$ of the following yellow dye-releasing redox compound, 0.13 g/m$^2$ of tricyclohexyl phosphate, 0.014 g/m² of 2,5-di-t-pentadecylhydroquinone and 0.7 g/m² of gelatin.

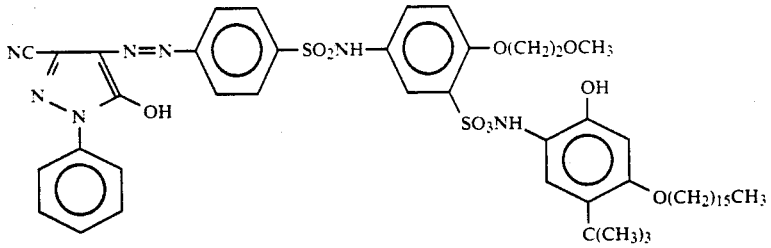

(18) Light-reflecting layer containing 0.7 g/m² of titanium oxide and 0.18 g/m² of gelatin.

(19) Low-sensitive blue-sensitive emulsion layer containing 0.25 g/m² (as silver) of internal latent image type direct positive silver bromide emulsion containing octahedral silver bromide grains having a grain size of 1.1 μm. the following blue-sensitizing dyes as in layer (20), 0.4 g/m² of gelatin, 2 μm/m² of the same nucleating agent (NA) as that in layer (7) and 0.045 g/m² of sodium 2-sulfo-5-n-pentadecylhydroquinone.

(20) High-sensitive blue-sensitive emulsion layer containing 0.42 g/m² (as silver) of an internal latent image type direct positive silver bromide emulsion containing octahedral silver bromide grains having a grain size of 1.7 μm, the following blue-sensitizing dyes, 0.45 g/m² of gelatin, 3.3 μg/m² of the same nucleating agent (NA) as that in Layer (7) and 0.025 g/m² of sodium 2-sulfo-5-n-pentadecylhydroquinone.

Blue-Sensitizing Dyes:

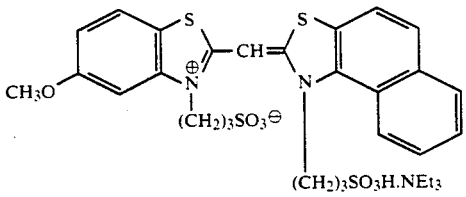

(0.4 mg per g of Ag)

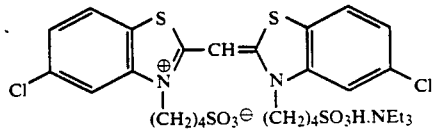

(0.8 mg per g of Ag)

(21) Ultraviolet-absorbing layer containing the following ultraviolet absorbents each in an amount of $4\times10^{-4}$ mol/m² and 0.5 g/m² of gelatin.

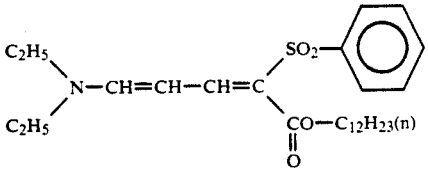

-continued

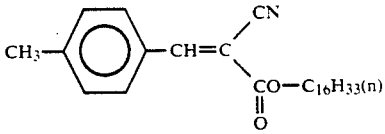

(22) Protective layer containing a mat agent and 1.0 g/m² of gelatin.

Cover Sheets:

The following cover sheets (A) to (I) were prepared, each of which had a transparent polyethylene terephthalate support coated with a gelatin-subbing layer and containing a light-piping-preventing dye.

Cover Sheet (A) (for comparison):

A layer containing 1 g/m² of gelatin was coated over the above-mentioned support.

Cover Sheet (B) (for comparison):

The following layers (1) to (3) were coated on the above-mentioned support.

(1) Neutralizing layer containing 7.8 g/m² of cellulose acetate (acetylation degree: 55.5%) and 5.2 g/m² of methyl vinyl ether/maleic anhydride copolymer.

(2) Layer containing a blend (5/5, by mol as solid content ratio) comprising a polymer latex prepared by emulsion polymerization of styrene/butyl acrylate/acrylic acid/N-methylolacrylamide in a weight ratio of 49.7/42.3/4/4 and a polymer latex prepared by emulsion polymerization of methyl methacrylate/acrylic acid/N-methylolacrylamide in a weight ratio of 93/3/4, the total solid content being 3.9 g/m².

(3) Layer containing 1 g/m² of gelatin.

Color Sheet (C) (embodiment of the invention):

The following layers (1) to (3) were coated on the above-mentioned support.

(1) Same as Layer (1) of Cover Sheet (B).

(2) Same as Layer (2) of Cover Sheet (B).

(3) Dye-trapping layer containing 1 g/m² of the following polymer latex mordant (polymmerization ratio and 1 g/m² of gelatin.

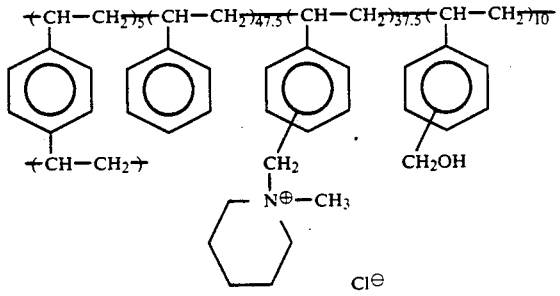

Cover Sheet (D) (embodiment of the invention):

The following layers (1) to (3) were coated on the above-mentioned support.

(1) Neutralizing layer containing 10.4 g/m$^2$ of acrylic acid/butyl acrylate (8/2, by mol) copolymer having an average molecular weight of 50,000 and 0.1 g/m$^2$ of 1,4-bis(2,3-epoxypropoxy)-butane.

(2) Neutralization-timing layer containng 4 g/m$^2$ of Compound (1) as mentioned above in the item (H) for "Layer Having a Neutralizing Function".

(3) The same dye-trapping layer as Layer (3) of Cover Sheet (C).

Cover Sheet (E) (embodiment of the invention):

The following layers (1) to (3) were coated on the above-mentioned support.

(1) The same neutralizing layer as Layer (1) of Cover Sheet (D).

(2) Neutralization-timing layer containing 2.9 g/m$^2$ of Compound (8) as mentioned above in the item (H) for "layer having a neutralizing function" and 0.29 g/m$^2$ of poly(methylvinyl ether-comonomethyl maleate).

(3) The same dye-trapping layer as Layer (3) of Cover Sheet (C).

Cover Sheet (F) (embodiment of the invention):

The following layers (1) to (3) were coated on the above-mentioned support.

(1) The same neutralizing layer as Layer (1) of Cover Sheet (D).

(2) The same neutralization-timing layer as Layer (2) of Cover Sheet (E).

(3) Dye-trapping layer containing 1.5 g/m$^2$ of the following polymer latex mordant (polymerization ratio by mol) and 1.5 g/m$^2$ of gelatin.

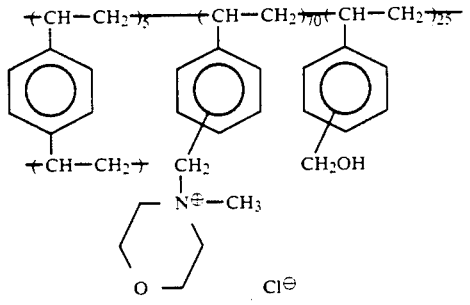

Cover Sheet (G) (for comparison):

The following layer (4) was coated over Cover Sheet (E).

(4) Layer containing 1 g/m$^2$ of acetyl cellulose having an acetylation degree of 55%.

Cover Sheet (H) (for comparison):

The following layers (1) to (3) were coated on the above-mentioned support.

(1) The same neutralizing layer as Layer (1) of Cover Sheet (D).

(2) The same neutralization-timing layer as Layer (2) of Cover Sheet (E).

(3) Trapping mordant layer containing 2 g/m$^2$ of acetyl cellulose having an acetylation degree of 55% and g/m$^2$ of poly(vinylbenzyltrihexylammonium chloride).

Cover Sheet (I) (for comparison):

Only the same dye-trapping layer as Layer (3) of Cover Sheet (C) was coated on the above-mentioned support.

The above-mentioned image-receiving light-sensitive sheet was exposed through a color test chart and was superposed to one of the above-mentioned Cover Sheets (A) to (G), and the processing composition mentioned below was spread between the two sheets in a thickness of 75 μm, whereupon spreading was effected by the aid of a pressure roller. Accordingly, processing of the photographic sheet was effected at 2° C. and the cover sheet was peeled off from the thus processed photographic sheet after 2 minutes and 30 seconds or 10 minutes. The unnecessary parts of the sheet were peeled at the position of the peeling layer in the light-sensitive sheet, whereby the color image formed was directly observed.

| Composition of Processing Composition: | |
|---|---|
| 1-Phenyl-4-hydroxymethyl-4-methyl-3-pyrazolidone | 15 g |
| Benzotriazole | 6 g |
| Potassium Sulfite | 8 g |
| Hydroxyethyl Cellulose | 30 g |
| Potassium Hydroxide | 64 g |
| Benzyl Alcohol | 3.4 g |
| Carbon Black | 150 g |
| Water to make | 1 kg |

The maximum density of the transferred image was obtained for each processing time (2 minutes and 30 seconds, or 10 minutes), and the density ratio of the sample processed for 2 minutes and 30 seconds to that processed for 10 minutes was represented by percentage. The results are shown in Table 1 below.

In addition, the minimum density of the transferred image was obtained for the processing time of 10 minutes, and the results are shown in Table 2 below.

In these tables, B, G and R represent the transferred density measured with blue, green and red filters, respectively.

TABLE 1

| | | Maximum Density of Transferred Image | | | | | | | | |
|---|---|---|---|---|---|---|---|---|---|---|
| | | peeled in 2 min 30 sec | | | peeled in 10 min | | | Density Ratio (%) | | |
| | Cover Sheet | B | G | R | B | G | R | B | G | R |
| A | Comparison | 1.12 | 1.85 | 2.14 | 2.36 | 2.48 | 2.31 | 47 | 75 | 93 |
| B | " | 1.10 | 1.83 | 2.08 | 2.18 | 2.27 | 2.27 | 50 | 81 | 92 |
| C | Embodiment of the Invention | 1.28 | 1.63 | 1.97 | 1.65 | 1.90 | 2.12 | 78 | 86 | 93 |
| D | Embodiment of the Invention | 1.30 | 1.65 | 1.98 | 1.64 | 1.88 | 2.11 | 79 | 88 | 94 |
| E | Embodiment of the Invention | 1.31 | 1.64 | 1.99 | 1.65 | 1.90 | 2.11 | 79 | 86 | 94 |
| F | Embodiment | 1.29 | 1.63 | 1.98 | 1.62 | 1.85 | 2.10 | 80 | 88 | 94 |

TABLE 1-continued

| Cover Sheet | Maximum Density of Transferred Image: peeled in 2 min 30 sec B | G | R | peeled in 10 min B | G | R | Density Ratio (%) B | G | R |
|---|---|---|---|---|---|---|---|---|---|
| of the Invention | | | | | | | | | |
| G Comparison | 1.11 | 1.82 | 2.07 | 2.17 | 2.26 | 2.26 | 51 | 81 | 92 |
| H " | 1.13 | 1.80 | 2.05 | 2.16 | 2.27 | 2.27 | 52 | 79 | 90 |
| I " | 1.32 | 1.65 | 2.00 | 1.67 | 1.93 | 2.15 | 79 | 85 | 93 |

TABLE 2

| Cover Sheet | Minimum Density of Transferred Imageas peeled in 10 min B | G | R |
|---|---|---|---|
| A Comparison | 0.33 | 0.27 | 0.52 |
| B " | 0.19 | 0.15 | 0.32 |
| C Embodiment of the Invention | 0.19 | 0.16 | 0.31 |
| D Embodiment of the Invention | 0.18 | 0.15 | 0.30 |
| E Embodiment of the Invention | 0.19 | 0.15 | 0.29 |
| F Embodiment of the Invention | 0.19 | 0.16 | 0.30 |
| G Comparison | 0.19 | 0.15 | 0.31 |
| H " | 0.19 | 0.15 | 0.31 |
| I " | 0.25 | 0.23 | 0.45 |

As is obvious from the results in Table 1 above, the density ratio of the transferred images formed in the samples of the present invention (having Cover Sheets (C) to (F)) was higher at the early stage (when peeled in 2 minutes and 30 seconds) than those formed in the comparative samples (having Cover Sheets (A) to (B)), although the maximum density of the transferred images in the former samples of the present invention when peeled in 10 minutes was lower than that in the latter comparative samples. The effect was noticeable in the density obtained by using Cover Sheet (B) which is furthest from the image-receiving layer. This fact means that the variation of the peeling time does not result in a significant fluctuation of the color balance which greatly influences the image quality and that the image-completing time is short.

On the other hand, in the case of the sample having Cover Sheet (G) where the dye-trapping layer has the timing layer on the side which faces the processing composition or in the case of the layer constitution which is similar to the invention of U.S. Pat. No. 3,930,864 such as the sample having Cover Sheet (H) as the trapping mordant layer, the effect of the present invention could not be obtained. From the results, the excellent effect of the present invention is obvious.

From the results in Table 2 above, it is also noted that the sample having Cover Sheet (A) which has no neutralizing layer gave an image having a high minimum density and therefore the quality of the image formed was extremely poor.

Regarding the sample having Cover Sheet (I) comprising only the dye-trapping layer, the image-forming time would likely be shortened but the minimum density of the image formed was so high that the image quality was poor.

EXAMPLE 2

The image-receiving light-sensitive sheet (I) of Example 1 was combined with the cover sheet as indicated in Table 3 below, and the same processing composition as that employed in Example 1 was spread therebetween in a thickness of 75 μm.

After spreading the processing composition in each film unit, the unnecessary portions were peeled in 1 minute and 30 seconds, 2 minutes, 2 minutes and 30 seconds, 4 minutes, 10 minutes or 60 minutes, whereupon the pH value on the surface of the image-receiving layer was measured with a surface pH electrode immediately after being peeled.

From the results in Table 3 below, it is obvious that the samples with Cover Sheets (D) and (E) had a reverse S-shape neutralization characteristic.

TABLE 3

| Peeling Time | Surface pH Value Immediately After Peeling: Cover Sheet (C) | Cover Sheet (D) | Cover Sheet (E) |
|---|---|---|---|
| 1 min 30 sec | 12.3 | 12.9 | 12.8 |
| 2 min | 12.1 | 12.8 | 12.8 |
| 2 min 30 sec | 12.0 | 9.7 | 9.6 |
| 4 min | 11.3 | 7.9 | 7.7 |
| 10 min | 9.8 | 7.1 | 7.0 |
| 60 min | 7.7 | 6.5 | 6.4 |

EXAMPLE 3

The image-receiving light-sensitive sheet (I) of Example 1 was processed through a fine line-wedge for evaluation of sharpness and then attached to the cover sheet of Example 1 and thereafter processed with the processing solution of Example 1 in the same manner as in Example 1. Peeling was effected in 10 minutes.

The results obtained are shown in Table 4 below. As is obvious therefrom, the space frequency for giving a CTF of 0.5 was higher in the case of the samples having the cover sheets of the present invention than in the comparative samples, and accordingly, it is noted that the samples of the present invention have an extremely excellent sharpness.

In particular, the samples having Cover Sheets (D) to (F) which show the reverse S-shape neutralization characteristic showed an extremely high sharpness.

TABLE 4

| Cover Sheet | Space Frequency (G) for giving CTF of 0.5 (1/mm) |
|---|---|
| A Comparison | 2.4 |
| B " | 2.7 |
| C Embodiment of the Invention | 3.9 |
| D Embodiment of the Invention | 4.2 |

TABLE 4-continued

| Cover Sheet | | Space Frequency (G) for giving CTF of 0.5 (1/mm) |
|---|---|---|
| E | Embodiment of the Invention | 4.3 |
| F | Embodiment of the Invention | 4.4 |
| G | Comparison | 2.8 |
| H | " | 2.9 |
| I | " | 3.8 |

EXAMPLE 4

A comparative image-receiving light-sensitive sheet (II) was prepared.

Precisely, Layers (A) to (C) of Example 1 were coated on the back surface of the same support as that for the image-receiving light-sensitive sheet (I) of Example 1 and the following layers (1) to (24) were coated on the opposite surface thereof.

(1) Neutralizing layer containing 7.8 g/m$^2$ of cellulose acetate (acetylation degree: 55.5%) and 5.2 g/m$^2$ of methyl vinyl ether/maleic anhydride copolymer.

(2) Layer containing a blend (5/5, by mol as solid content ratio) of a polymer latex prepared by emulsion polymerization of styrene/butyl acrylate/-acrylic acid/N-methylolacrylamide (49.7/42.3/4/4, by weight) and a polymer latex prepared by emulsion polymerization of methyl methacrylate/acrylic acid/N-methylolacrylamide (93/3/4, by weight), the total solid content being 3.9 g/m$^2$.

(3) to (24) Same as Layers (1) to (22) in the image-receiving light-sensitive sheet (I) of Example 1.

One combination where the processing composition of Example 1 was spread between the image-receiving light-sensitive sheet (I) and Cover Sheet (E) in a thickness of 75 μm and another combination where the processing composition of Example 1 was spread between the image-receiving light-sensitive sheet (II) and Cover Sheet (I) in a thickness of 75 μm were prepared, and both units were processed under the conditions of 25° C. and 55% RH. Afterwards, the unnecessary parts were peeled in 10 minutes.

15 seconds after peeling, the samples were subjected to a scratch test where a sapphire needle having a diameter of the pointed end of 0.1 mm was applied to the samples under a load of 200 g.

After the test, the image-receiving light-sensitive sheet (I) of the invention was only weakly scratched, while the image-receiving layer of the comparative image-receiving light-sensitive sheet (II) was broken and the sheet (II) itself was extremely damaged.

From the test results, it is noted that the comparative sample having both the layer having a neutralizing function and the image-receiving layer on the same support is weak and is easily scratched and damaged.

EXAMPLE 5

The same two combinations as those in Example 4 were processed in the same manner as in Example 4, and the unnecessary parts were peeled apart after 10 minutes at 25° C. in both cases.

Next, the peeled image-receiving sheets were allowed to stand under the conditions of 25° C. and 15% RH for 3 hours and then subjected to a cutting test using a straw cutter.

As a result of the test, no failure was observed in the cut part of the image-receiving light-sensitive sheet (I) of the present invention, while noticeable fine cracks were observed in the cut part of the comparative image-receiving light-sensitive sheet (II), the cracks vertically running to the direction of the inside of the image plane from the cut edge.

From the test results, therefore, it is noted that the film unit sample of the present invention is free from the problem of film quality.

EXAMPLE 6

An image-receiving light-sensitive sheet (III) was prepared in the same manner as in Example 1 for preparing the image-receiving light-sensitive sheet (I), except for the following points:

(a) The amount of Layer (7) coated was 1.1 times.
(b) The amount of Layer (8) coated was 1.1 times.
(c) The amount of Layer (11) coated was 1.3 times.
(d) The amount of Layer (13) coated was 1.3 times.
(e) The amount of Layer (14) coated was 1.5 times.
(f) The amount of Layer (17) coated was 1.6 times.
(g) The amount of Layer (19) coated was 1.5 times.
(h) The amount of Layer (20) coated was 1.7 times.

This was combined with Cover Sheet (D) of Example 1 and processed with the processing composition of Example 1 in the same manner as in Example 1. The results obtained are shown in Table 5 below.

TABLE 5

| | Maximum Density | | |
|---|---|---|---|
| | B | G | R |
| Peeled in 2 min 30 sec | 1.60 | 1.82 | 2.15 |
| Peeled in 10 min | 2.08 | 2.19 | 2.31 |
| Density Ratio (%) | 77 | 83 | 93 |

From the results in Table 5 above, it is understood that the maximum density to be lowered by providing the dye-trapping layer of the present invention can be recovered by increasing the amounts of the light-sensitive layers to be coated almost without lowering the transferred image density ratio.

EXAMPLE 7

Using the same image-receiving light-sensitive sheet, cover sheet and processing composition as those in Example 1, the same process as in Example 1 was repeated, whereupon the image was observed from the side of the cover sheet 2 minutes after the processing solution was spread. The results obtained are shown in Table 6 below.

TABLE 6

| Cover Sheet | Observation |
|---|---|
| (A) | A light image was observed, which, however, disappeared after a period of time. |
| (B) | Almost no image was observed. |
| (C) | A light image was observed. |
| (D) | A light image was observed. |
| (E) | A light image was observed. |
| (F) | A light image was observed. |
| (G) | Almost no image was observed. |
| (H) | Almost no image was observed. |
| (I) | A light image was observed. |

In these samples, a light image was observed even from the side of the cover sheet. However, the minimum density was 2.05 so that it is understood that almost no color image was formed in these samples.

Accordingly, it is also understood that the present invention is far from the film unit of such a kind that two color images are formed in one film unit.

EXAMPLE 8

The following image-receiving light-sensitive sheets were prepared in the same manner as in Example 1, except that the support was varied as indicated below.

Image-Receiving Liqht-Sensitive Sheet (IV):

A paper support having a weight of 135 g/m$^2$ was laminated with polyethylene and then coated with a gelatin subbing layer. Over the thus prepared support, Layers (1) to (22) and Layers (A) to (C) were coated like the image-receiving light-sensitive sheet (I).

Image-Receiving Light-Sensitive Sheet (V):

Layers (A) to (C) of the sheet (I) were coated on the back surface of a gelatin subbing layer-coated transparent polyethylene terephthalate support. The front surface of the support was then coated with a white reflecting layer containing 2 g/m$^2$ of gelatin and 20 g/m$^2$ of titanium oxide, and Layers (1) to (22) of the sheet (I) were coated thereover.

Image-Receiving Light-Sensitive Sheet (VI):

Layers (1) to (22) of the image-receiving light-sensitive sheet (III) were coated on a gelatin subbing layer-coated transparent support, except that Layer (4) only was varied as indicated below. Then, 4 g/m$^2$ of gelatin was coated on the back surface of the thus coated support.

(4) Layer containing 1 g/m$^2$ of ethyl acrylate latex, 2.5 g/m$^2$ of gelatin and 1.5 g/m$^2$ of carbon black.

Each of the thus prepared image-receiving light-sensitive sheets (I), (IV), (V) and (VI) was combined with Cover Sheet (E) along with the processing composition of Example 1 and then processed in the same manner as in Example 1. Immediately after spreading the processing composition, the samples were exposed to a white lamp and then the unnecessary parts were peeled after 4 minutes. All the samples gave beautiful color images, like the sample having the sheet (I).

From the sample having the image-receiving light-sensitive sheet (VI), a transparent print was obtained.

From the above-mentioned examples, it is understood that only the film unit samples of the present invention gave color images having a high maximum transferred density and a low minimum transferred density along with a high sharpness whereupon the image-forming time is short in processing the film unit samples of the present invention. Additionally, the film unit samples of the present invention are free from the problem of film quality and are well handled under any daylight condition.

While the invention has been described in detail and with reference to specific embodiments thereof, it will be apparent to one skilled in the art that various changes and modifications can be made therein without departing from the spirit and scope thereof.

What is claimed is:

1. A color diffusion transfer photographic film unit comprising:

(1) a support having a light-shielding function in itself and/or having thereon a layer having a light-shielding function;

(2) a light-sensitive element on said support having a light-shielding function said element comprising in order from said support having a light-shielding function at least;

(a) a color image-receiving layer comprising mordant agent in a binder, (b) a peeling layer, and (c) at least one silver halide emulsion layer associated with a color image-forming substance;

(3) a light-shielding agent-containing alkali processing composition; and (4) a cover sheet comprising at least a layer having a neutralizing function on a transparent support;

wherein said cover sheet is characterized by having a dye-trapping layer comprising a mordant agent in a binder adjacent said alkali processing composition, and wherein said support having a light-shielding function further has a light-reflecting function in itself and/or has thereon a layer having a light-reflecting function, and wherein said layer having a light-reflecting function is on the side of said color image receiving layer (a) opposite said silver halide emulsion layer (c) and said layer having a light-shielding function is on the side of said layer having a light-reflecting function opposite said silver halide emulsion layer (c).

2. A color diffusion transfer photographic film unit as claimed in claim 1, said color image-forming substance is a non-diffusive dye-releasing redox compound.

3. A color diffusion transfer photographic film unit as claimed in claim 1, wherein said dye-trapping layer is the uppermost layer of said cover sheet and is or is not covered with a hydrophilic layer.

4. A color diffusion transfer photographic film unit as claimed in claim 1, wherein said support further has a light-reflecting function in itself and/or has thereon a layer having a light-reflecting function; said cover sheet is transparent; said dye-trapping layer is the outermost layer on the same side of the transparent support as said layer having a neutralizing function; and said light-shielding agent-containing alkali processing composition to be spread between the outermost layer of said light-sensitive element and said dye-trapping layer of said cover sheet.

5. A color diffusion transfer photographic film unit as claimed in claim 1, which is for obtaining a reflecting print, wherein said support is a white support and said layer having a light-shielding function is provided on the side of said support opposite said layers (a), (b) and (c).

6. A color diffusion transfer photographic film unit as claimed in claim 1, which is for obtaining a reflecting print, wherein said support is a black support and said layer having a light-reflecting function is provided between said black support and said color image-receiving layer (a).

7. A color diffusion transfer photographic film unit as claimed in claim 1, which is for obtaining a reflecting print, wherein a layer having a light-reflecting function is provided between said support and said color image-receiving layer (a) and said layer having a light-shielding function is provided on the side of said support opposite said layers (a), (b) and (c).

8. A color diffusion transfer photographic film unit as claimed in claim 1, which is for obtaining a reflecting print, wherein a layer having a light-reflecting function is provided between said support and said color image-receiving layer (a) and said layer having a light-shielding function is provided between said support and said layer having a light-reflecting function.

9. A color diffusion transfer photographic film unit as claimed in claim 1, which is for obtaining a reflecting print, wherein said support has both a light-shielding function and a light-reflecting function by itself and said layers (a), (b) and (c) are provided on the surface having a white light-reflecting function of said support.

10. A color diffusion transfer photographic film unit as claimed in claim 1, wherein the distance between said color image-receiving layer (a) and said color image-forming substance that is nearest to said color image-receiving layer (a) is 5 μm or less.

11. A color diffusion transfer photographic film unit as claimed in claim 1, the amount of said mordant agent in said dye-trapping layer is less than that in said color image-receiving layer (a).

12. A color diffusion transfer photographic film unit as claimed in claim 1, wherein the binder in said dye-trapping layer is gelatin.

13. A color diffusion transfer photographic film unit as claimed in claim 1, wherein a pH-lowering procedure in said layer having a neutralizing function is in the form of a reverse S-shape during processing of said film unit.

* * * * *